United States Patent [19]

Jakob

[11] 3,945,407

[45] Mar. 23, 1976

[54] MULTIPLE FILAMENT WOVEN-IN SLIDE FASTENER ELEMENT

[75] Inventor: Horst Jakob, Choisy-le-Roi, France

[73] Assignee: Prestil, Choisy-le-Roi, France

[22] Filed: Jan. 23, 1975

[21] Appl. No.: 543,467

Related U.S. Application Data

[60] Division of Ser. No. 429,819, Jan. 2, 1974, which is a continuation-in-part of Ser. No. 295,019, Oct. 4, 1972, abandoned.

[30] Foreign Application Priority Data

Oct. 13, 1971 France ..... 71.36698

[52] U.S. Cl. ..... 139/384 B; 24/205.13 C

[51] Int. Cl.[2] ..... D03D 3/00; A44B 19/12

[58] Field of Search ..... 139/384 B, 11, 116, 118, 139/385; 24/205.1 C, 205.13 C, 205.16 C

[56] References Cited

UNITED STATES PATENTS

| | | | |
|---|---|---|---|
| 1,702,289 | 2/1929 | Zimmerer, Jr. | 139/385 X |
| 3,189,964 | 6/1965 | Galonska | 24/205.13 C |
| 3,423,803 | 1/1969 | Fromlich | 24/205.13 C |
| 3,692,068 | 9/1972 | Ader et al. | 139/116 |

FOREIGN PATENTS OR APPLICATIONS

| | | | |
|---|---|---|---|
| 1,221,114 | 2/1971 | United Kingdom | 24/205.16 C |
| 1,280,111 | 11/1961 | France | 24/205.13 C |
| 248,200 | 2/1948 | Switzerland | 24/205.13 C |
| 1,945,315 | 3/1971 | Germany | 24/205.16 C |

*Primary Examiner*—James Kee Chi
*Attorney, Agent, or Firm*—Arthur B. Colvin

[57] ABSTRACT

This method and the apparatus for carrying out same are characterised essentially in that, during the weaving of the tape of the element, two separate filaments are inserted into the texture for constituting the fastening or coupling members propers by engaging by turns one and the other filaments between the warp yarns, at spaced intervals, to constitute at each point of insertion a transverse loop wound in one direction for one filament and in the opposite directions for the other filament, and meanwhile these filaments are disposed in the longitudinal direction on the side opposite to the coupling members proper, whereby these filaments constitute two variable-pitch helices of which the loops wound in opposite directions are imbricated, every other loop belonging to the same helix.

1 Claim, 15 Drawing Figures

FIG.2
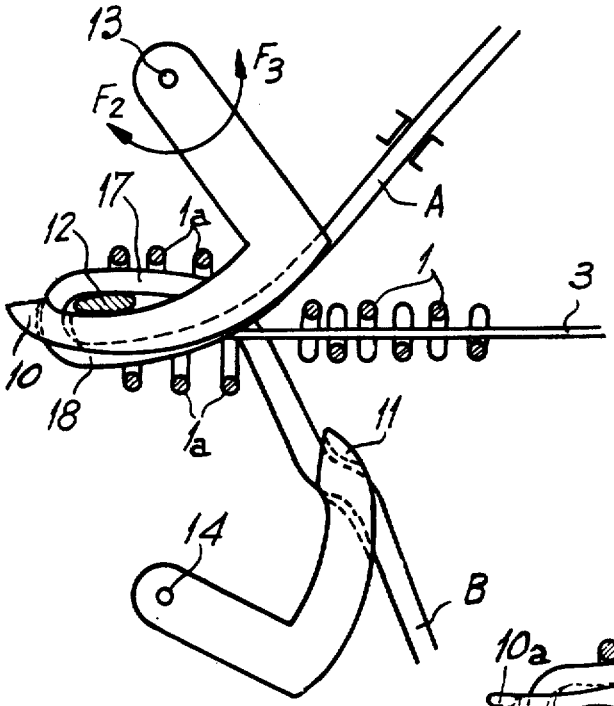
FIG.9
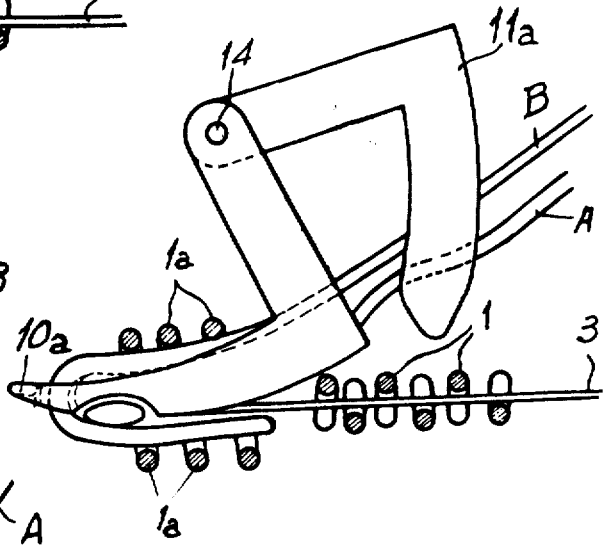
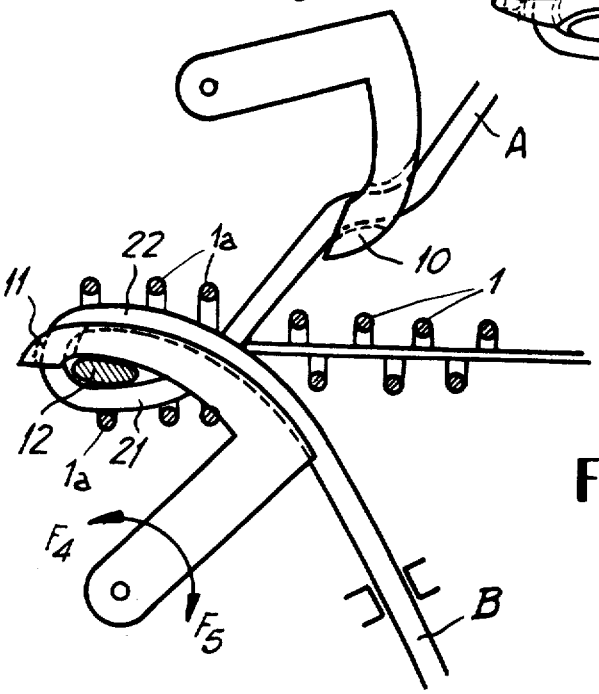
FIG.3

MULTIPLE FILAMENT WOVEN-IN SLIDE FASTENER ELEMENT

This is a division of application Ser. No. 429,819 filed Jan. 2, 1974, which was a continuation-in-part of application Ser. No. 295,019, filed Oct. 4, 1972, now abandoned.

FIELD OF INVENTION

The present invention relates to the manufacture of slide fastener elements, namely the elements comprising a tape of flexible material carrying a row of coupling members adapted to be coupled with another similar row by means of a control slide or tab.

DESCRIPTION OF THE PRIOR ART

Various methods of manufacturing such elements have already been proposed. According to one of these known methods the coupling members of the same rows are obtained by means of a continuous filament by so shaping this filament as to form a series of loops adapted to project from one edge of the corresponding supporting tape, the tape edges advantageously comprising thicker portions or other deformations adapted to facilitate the proper coupling with similar members carried by another identical element. To this end, the filament employed for making the coupling members may be caused to follow a coil or meander path.

In most instances these rows of coupling members thus obtained are manufactured independently of the corresponding carrier tapes, and subsequently secured thereto by suitable means, notably by sewing.

But according to a specific manufacturing method each row of coupling members is obtained during the very operation consisting in weaving the corresponding tape, so that the filament utilized therefor is woven as a weft yarn with the warp yarn of this tape. This method is advantageous in that it eliminates the subsequent operation consisting in fixing the rows of coupling members to the corresponding carrier tapes.

However, the presence of this filament in the tape texture tends to produce a certain tape distortion. This effect is due to the fact that the filament, having different physical properties in comparison with those of the textile yarns of the tape, comprises loops all wound in the same direction.

SUMMARY OF THE INVENTION

It is therefore the object of the present invention to provide a novel method of manufacture intended to eliminate this drawback.

This method is characterised essentially in that, during the weaving of the tape of the element, two separate filaments are inserted into the texture for constituting the fastening or coupling members propers by engaging by turns one and the other filaments between the warp yarns, at spaced intervals, to constitute at each point of insertion a transverse loop wound in one direction for one filament and in the opposite directions for the other filament, and meanwhile these filaments are disposed in the longitudinal direction on the side opposite to the coupling members proper, whereby these filaments constitute two variable-pitch helices of which the loops wound in opposite directions are imbricated, every other loop belonging to the same helix.

The element thus obtained is advantageous in that it is perfectly symmetrical and free of any tendency to twist up since both fastener filaments are wound in opposite directions. Moreover, the control tab can be engaged indifferently in one or the other longitudinal direction on two sections of this element for obtaining a complete slide fastener.

The present invention is also concerned with an apparatus for carrying out the method broadly disclosed hereinabove. This apparatus comprises a weaving loom arranged to provide laterally the space necessary for the operation of two needles adapted to introduce the two fastener filaments, said needles being disposed in close vicinity of the weft yarn weaving member, across the movable sheet of warp yarns, whereas a retractable member adapted to retain each loop formed by the two filaments registers with one of the two edges of the sheet of warp yarns. On the other hand, adequate control means are provided for alternatively engaging one and the other needles and insert the two filaments beyond the corresponding edge of the warp yarns, and retracting said needles to a fixed waiting position, and meanwhile bringing the retaining member to its operative position and retracting same from this position.

Of course, this invention is also concerned with the slide fastener elements obtained by carrying out the method of this invention, preferably by means of the apparatus broadly described hereinabove.

BRIEF DESCRIPTION OF THE DRAWINGS

However, other specific features and advantages of this invention will appear as the following description proceeds with reference to the attached drawings given by way of illustration and showing diagrammatically the coupling members with a relative spacing considerably greater than the spacing obtaining in actual practice, in order to facilitate the understanding of the invention. In the drawings:

FIG. 2 is a cross-section taken along the line II—II of FIG. 1, showing the members utilized for weaving the two fastener filaments;

FIG. 3 is a similar view showing the same members in different working positions;

FIG. 9 is a view similar to FIGS. 2 and 3 showing a modified form of embodiment of the manufacturing method of this invention.

DESCRIPTION OF THE PREFERRED EMBODIMENTS

The apparatus employed for carrying out the method of this invention comprises a weaving loom adapted to be operated for weaving this tape. Preferably, a needle loom is used, advantageously a single-needle loom capable of operating at high production rates.

Figure 10:
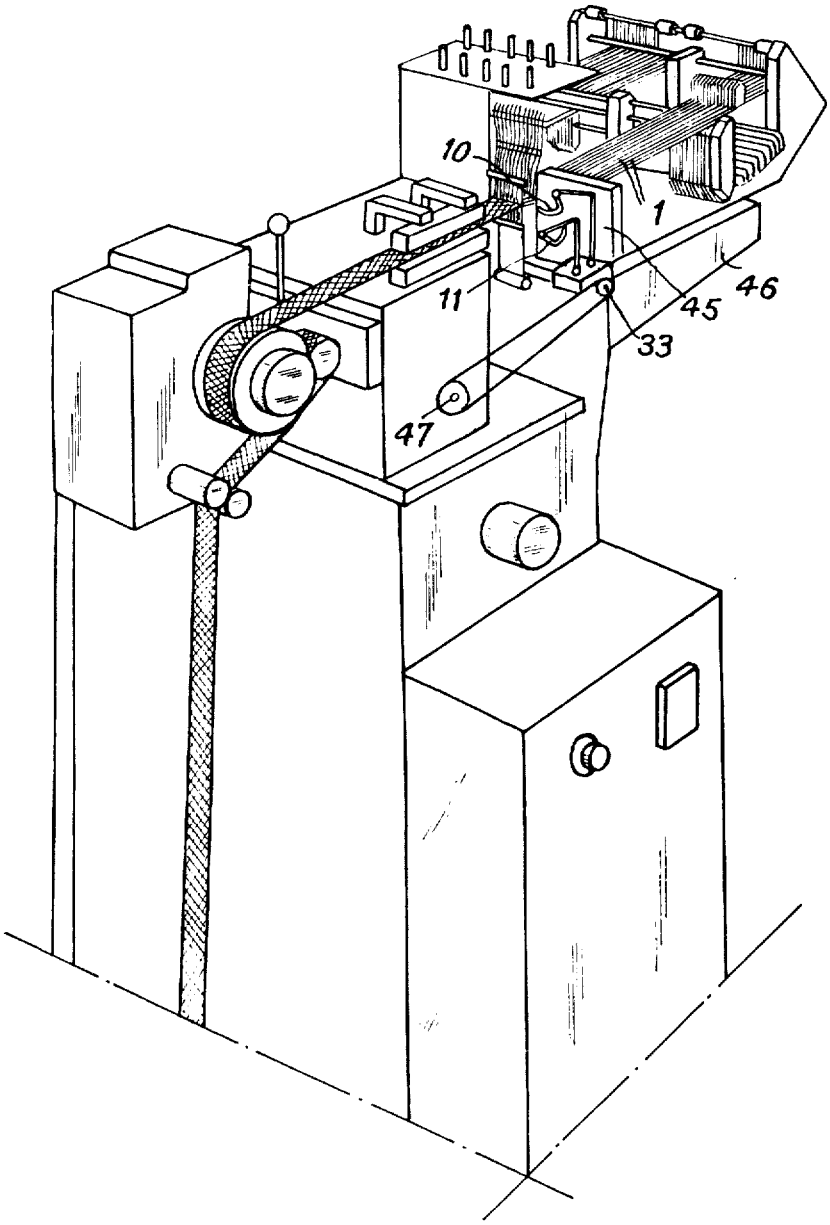
FIG. 10 is a perspective view of a loom for carrying out the method of this invention.

Thus, for instance, a needle loom such as the "BONAS ES 1/D4" manufactured by the British Company BONAS MACHINE COMPANY LIMITED of Sunderland (G.-B.). This loom, converted for operation according to the method of this invention, is illustrated in FIG. 10.

Figure 1:
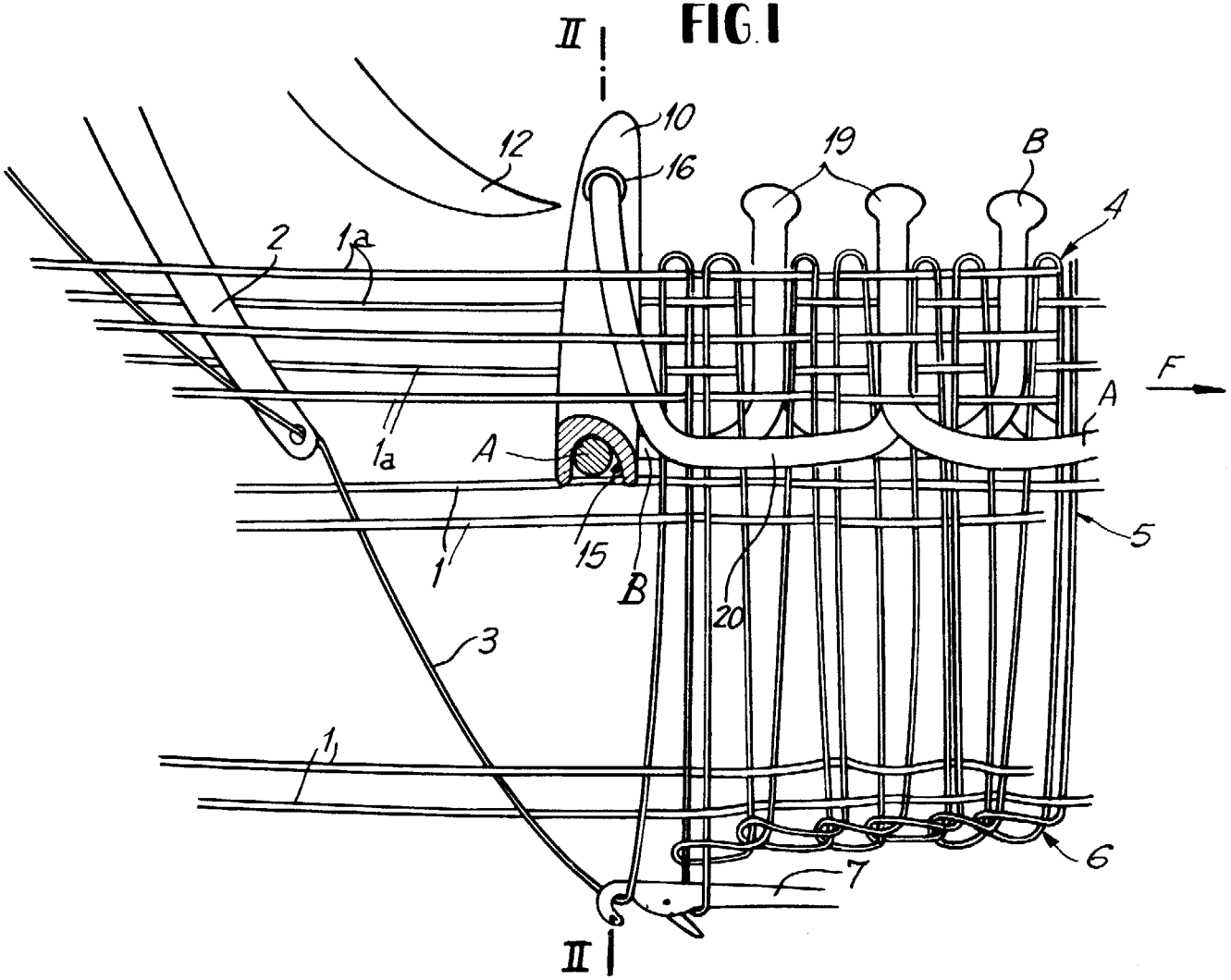
FIG. 1 is a diagrammatic plane view from above showing the manufacture of a fastener element according to this invention.
Figure 4:
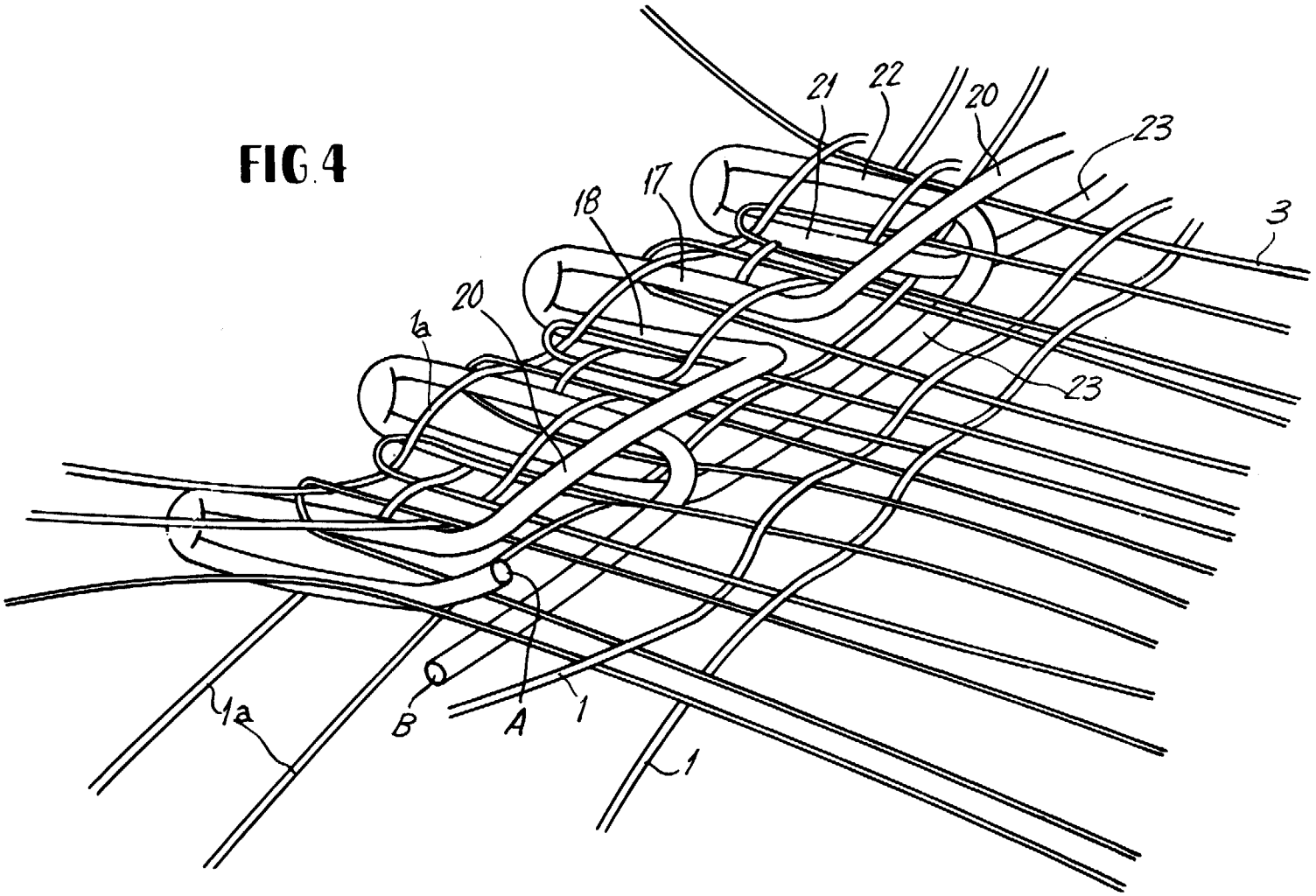
FIG. 4 is a diagrammatic perspective view showing a fastener element obtained according to the teachings of this invention.

In this loom, the various warp yarns 1 constitute initially a sheet travelling in the direction of the arrow F past the needle 2 used for weaving the weft yarn 3. This yarn comprises simple loops disposed along one of the edges 4 of the relevant tape 5. However, on the opposite edge 6 a needle of known type, such as a latch needle 7, is provided for interconnecting the various warp yarn loops, as illustrated in FIG. 1.

In the vicinity of the position occupied by the weft yarn needle 2 two members adapted to insert two filaments A and B are provided. Thus said members are in the area where the warp yarns 1 are still divided into two separate sheets through the action of the loan heddles. The two filaments A and B are adapted to constitute the coupling members of the corresponding fastener element. The members adapted to insert said filaments consist of a pair of needles 10 and 11, respectively, disposed on either side of the sheets formed by the warp yarns, in front of one and the other face of these two sheets.

It may be noted more particularly that, due to their specific arrangement, these two needles are capable of forming, with one and the other filaments, loops wound in opposite directions, as will be described in detail presently.

These needles are of course movable and controlled by mechanical means designed for alternatively engaging one and then the other needle inbetween the two sheets of warp yarns, beyond the edge 4 of the tape, then returning the needle backards in order to form each time a loop with the corresponding filament.

To this end, the present apparatus comprises likewise a retractable retaining member 12 adapted to retain in position the loop formed by each filament as the corresponding needle 10 or 11 accomplishes its return or backward stroke. However, this member is subsequently retracted for resuming its operative position when the next loop is about to be made by means of the other filament of the fastener.

In the example illustrated, the two needles 10 and 11 are advantageously elbow, bent or curved needles and each of them is rotatably mounted about a pivot pin 13 or 14 substantially parallel to the warp yarns. These needles are perfectly symmetric and as will be explained presently their movements are also symmetric in relation to the median plane of the slide fastener.

Beyond their elbow, these needles 10 and 11 comprise each a groove 15 formed on the side opposite to the relevant axis of rotation, this groove 15 leading to the hole 16 of each needle and adapted to receive the relevant fastener filament A or B.

These two needles are controlled by cam means or any other suitable mechanism. The same applies to the loop retaining member 12 of the two fastener filaments.

Figure 11:
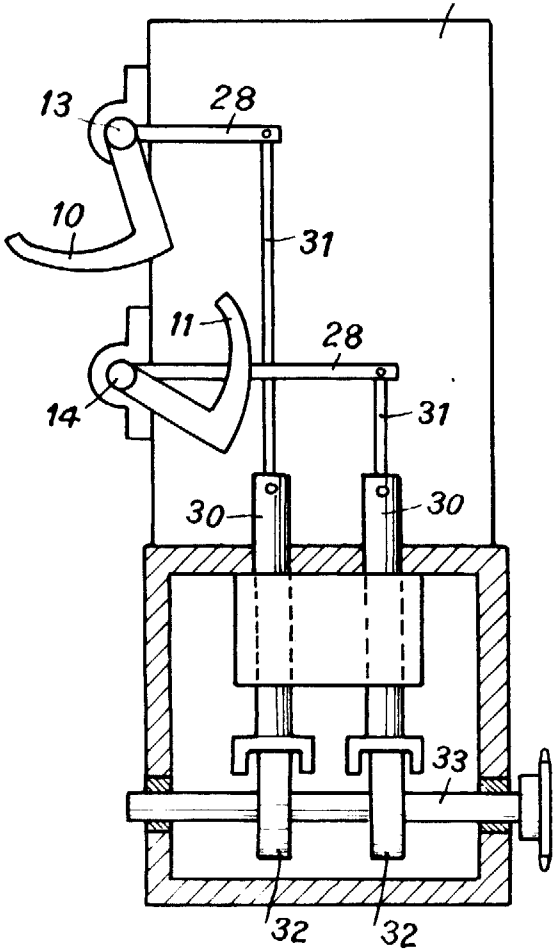
FIG. 11 is a part-sectional, part-elevational view of the device controlling the needles for inserting the two filaments.

FIG. 11 illustrates a typical embodiment of the device for controlling the movements of the pair of needles 10 and 11. The rods 13 and 14 carrying these needles are rotatably mounted in bearings carried by a support 45 secured to the frame structure 46 of the loom shown in FIG. 10. Each rod 13, 14 carries a lateral arm 28 connected through a link 31 to a control member 30 adapted to pull or push said link. The two control member thus provided engage a pair of rotary cams 32 carried by a shaft 33. This shaft 33 is operatively connected to the end of one of the rotary shafts 47 of the loom.

Spring means, not shown, constantly urge the control members 30 in engagement with the corresponding cams. The cam contours are such that when actuate these control members 30 in order to cause with the proper timing the rotation of one of the two needles 10 or 11 in one direction then in the opposite direction, whereafter a similar action is exerted on the other needle, and so forth as will be explained in detail presently.

Figure 13:
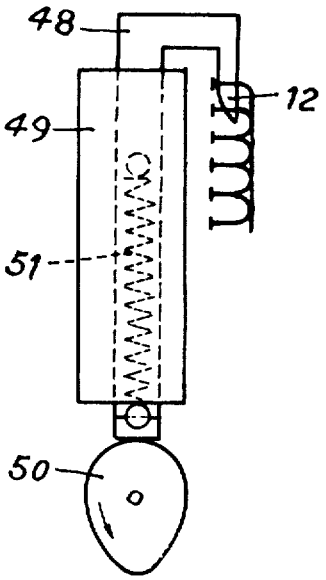
FIG. 13 is another diagram showing in plane view from above the device for controlling the movable loop retaining member associated with each filament.

FIG. 13 illustrates a typical embodiment of a device for controlling the movable member 12 adapted to retain the loops of the two fastener filaments. This member is carried by the cranked end of a rod 48 slidably mounted in a guide member 49 secured to the top of the loom.

The opposite end of this rod is resiliently urged for engagement with a control cam 50 rotatably driven from a shaft coupled to one of the power shafts of the loom. A spring 51 is provided to this end.

Now the cam contour is such that at the proper time the cam 50 causes the retaining member 12 to be inserted into the loops formed by one of the fastener filaments A or B, whereafter this member 12 is retracted as another loop is formed by the other filament, and so forth.

It is not compulsory to provide a specific device for feeding the fastener wires A and B. In fact, these may be simply pulled as necessary by the fastener tape during the weaving operation, inasmuch as the fastener wires A and B are incorporated in said tape and the latter is driven forwards in the loom.

However, in this case it is nevertheless necessary to provide a device for braking one or the other filaments or wires A and B and thus tensioning them and properly shape the loops.

The arrangement is such that at predetermined time intervals the needle 10 penetrates between the two sheets of warp yarns 1 for example at an intermediate point of the width thereof. To facilitate the penetration of both needles at this specific point, the conventional cam means controlling the heddles for separating the warp yarns of the two sheets may be modified, at least as far as some of these heddles are concerned.

In fact, this modification may involve only the warp yarns 1*a* located along the selvedge of the tape and between which the fastener filaments A and B are inserted.

The cams controlling the heddles associated with these warp yarns 1*a* are then modified with a view to accentuate the separation of these yarns, as illustrated in FIGS. 2 and 3 and thus facilitate the engagement of one of the needles 10 or 11 between these yarns. On the other hand, the cams controlling the heddles of the other warp yarns 1 may be modified with a view to reduce the relative spacing of these yarns at the same point and for the same purpose, but it will readily occur to those conversant with the art that this last-mentioned modification is quite conventional in a weaving loom.

The insertion of the needle 10 takes place of course by means of a rotational movement of said needle 10 as shown by the arrow $F_2$. Said needle will thus cause the filament A to form the first half 17 of the loop to be obtained at this position. When the needle 10 has reached its outermost position beyond the edge 4, the retaining member 12 is brought to its operative position as shown in FIG. 2. Then, the needle 10 is caused to recede due to its rotation in the direction of the arrow $F_3$, so as to lay down locally the other half 18 of the loop to be formed at this location.

During this operation, the retractable member 12 retains in position the loop thus formed, so that it cannot be pulled backwards during the return movement of the needle 10 to its inoperative position. However, this retaining member is also adapted to permit a distortion of the filament section in order to constitute a coupling member 19 of the fastener during the same manufacturing process.

In fact, the traction exerted on the filament in the backward direction causes this filament to be elongated against the retaining member 12. Now this elongation is attended by a modification in the cross-sectional shape of the filament and therefore by the development of two lateral projections therein, as illustrated in FIG. 1. Thus, a coupling member is obtained which is adapted to catch identical members formed along the other fastener element during the actual use of imbrication of the fastener elements.

Figure 12:
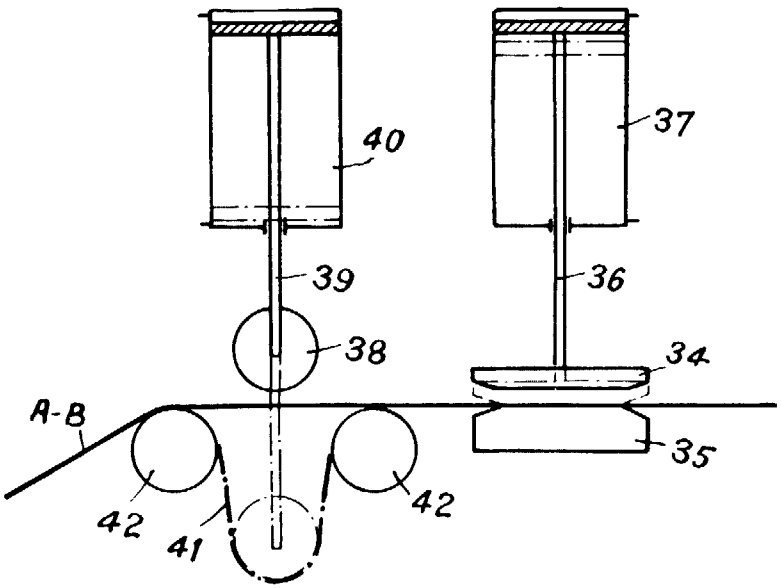
FIG. 12 is a diagram illustrating an ancillary device for tensioning one of these filaments.

FIG. 12 illustrates a typical embodiment of a device suitable for tensioning each fastener filament A or B, and for tensioning same at the end of each loop.

This device comprises a holding clamp consisting of a movable jaw 34 registering with a fixed jaw 35, on either side of the passage of the corresponding wire 8. The movable jaw 34 is carried by the rod 36 of a control cylinder 37.

Downstream of this clamp, i.e. on the side located in the direction of the point of insertion of the wire 8 into the tape during the weaving operation, a movable member adapted to tighten the wire loop formed downstream is provided. This member consists of a roller 38 carried by a rod 39 of a control cylinder 40. This roller 38 registers with the wire A or B and can thus push the latter back and cause same to form a loop 41 between the pair of fixed rollers 42.

As a consequence of the formation of this loop, the wire A or B is pushed backwards so as to absorb any slack therein while tensioning the loop formed by this wire.

Of course, the jaw 34 must be in its clamping position during this phase.

The operations of cylinders 37 and 40 is controlled by suitable means in synchronism with the other component elements of the machine.

The elongation of each filament A and B on said retaining member 12 may if desired be completed by the application of heat to well-defined spots, in order to facilitate the formation of these coupling members 19, the fastener elements consisting advantageously of thermoplastic material. This local heating action may be produced by using jets or heated air or an inert hot gas, such as nitrogen, or any other suitable and known means. Thus, the retractable retaining member may be connected to a suitable generator of supersonic waves capable of heating the filament.

When the first looping needle 10 has been withdrawn, it remains stationary in its inoperative position as shown in FIG. 3. But in this position it permits the free winding off of filament A in the direction of the warp yarns, as these yarn continue their forward or feed movement. Thus, a connecting portion 20 between two successive transverse loops can be completed.

However, during this time, the needle 2 of the weaving loom makes one or several picks with the weft yarn.

Then, the second looping needle 11, which remained stationary during the above-described operation, becomes operative in turn by introducing the other filament B into the gap between the two sheets of warp yarns. The mode of operation of this needle is then the same as that of the first looping needle 10, with the difference however that the winding of the loops formed with this filament B takes place in the reverse direction in comparison with the winding of the loops formed with filament A. This is due to the fact that the two needles 10 and 11, having the same shape, are disposed in opposition to each other on either side of the sheet of warp yarns.

Thus, during its operative stroke (in the direction of the arrow $F_4$) the second needle 11 will lay down the first side or portion 21 of the loop to be formed at this location by filament B. But it should be noted that this loop side is then located at the bottom, considering the planes of FIGS. 2 and 3, whereas the first side 17 of the loops formed with filament A were placed at the top.

When this needle 11 has attained its endmost position illustrated in FIG. 3, the retaining member 12 resumes its operative position previously abandoned after the return stroke of the first looping needle 10 towards its inoperative position. Then the second needle 11 resumes by itself its inoperative position by rotating in the direction of the arrow $F_5$, so as to lay down the second side 22 of the loop. But, at the same time, a coupling member 19 is formed on the projecting end of this loop, as described hereinabove in connection with the mode of operation of the first needle 10.

The second looping needle 11 then remains stationary in its inoperative position illustrated in FIG. 2, while permitting the free winding off of filament B in order to form a connecting portion 23 between the two transverse and successive loops formed with said filament B.

During this period, the needle 2 of weft yarn 3 makes one or several picks, and subsequently the first looping needle 10 resumes its operative position for making another loop with filament A, and so forth.

Figure 6:
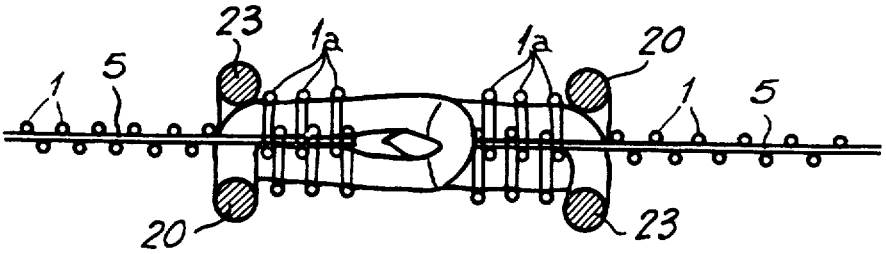
FIG. 6 is a section taken along the line VI—VI of FIG. 5.

Thus, transverse loops are formed alternatively with one and the other filaments A, B, by winding these filaments in opposite directions. Besides, the connecting portions 20 and 23 between the successive transverse loops formed from the two filaments A and B are located on one and the other faces of the corresponding tape. As can be seen in FIG. 6 these filaments A and B will thus form identical projections on the two faces of the tape, in relation to the median plane of the fastener element.

In this respect, it may be noted that the two filaments A and B are not woven with the warp and weft yarns of the tape, as observed in certain known prior art manufacturing processes. In fact, these filaments are simply inserted in between the warp and weft yarns. Moreover, these filaments comprise both transverse portions, namely the transverse loops, and longitudinal portions, namely the connecting portions or sections 20 or 23.

Due to the particular method of distributing the filaments A and B, each filament forms along the tape selvedge or marginal portion a variable-pitch coil constituting a series of loops disposed in transverse planes and connecting elements 20, 23 extending in the longitudinal direction. But, as already explained in the foregoing, the transverse loops of these two coils are wound in opposite directions.

One of the essential advantages deriving from the method of this invention lies in the fact that the winding of the loops formed with the two filaments in opposite directions affords a positive balance between the possible tendency to twist up, which might develop as a consequence of the winding of these filaments between the warp yarns and the weft yarns of the tape.

Figure 5:
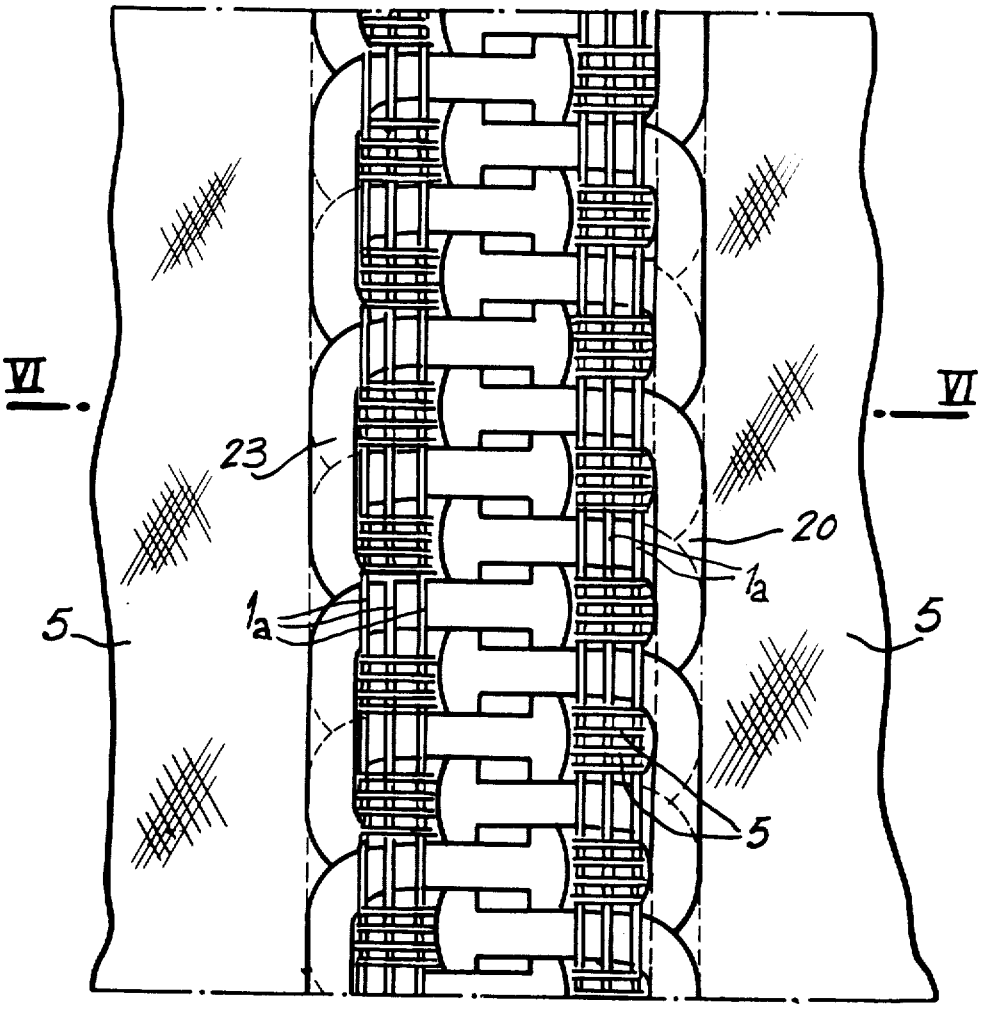
FIG. 5 is a diagrammatic plan view from above of a slide fastener consisting of two elements manufactured according to the teachings of this invention.

Another advantageous features is that the elements thus obtained is perfectly symmetrical. Thus, it is possible to cut out two sections of this element and assemble these sections with each other after turning them in opposite end to end relationship. Besides, FIGS. 5 and 6 illustrate a complete slide fastener thus obtained by assembling two sections of a same fastener element manufactured according to the teachings of this invention.

Another advantageous feature consists in that the control tabs can be set in position in one or the other direction, indifferently. This is also due to the perfect symmetry of the fastener elements obtained by carrying out the method of this invention. Now, this easy tab fitting possibility constitutes an important advantage notably in the manufacture of certain ready-made garments.

Another advantageous feature characterising this invention relates to the improved tab guiding section afforded by its method. In fact, by virtue of the symmetry of the element section thus obtained two identical projecting beads are formed on one and the other face of this section. Thus, these beads act as guide rails for the slide or tab on one end and the other face of the element. Now in most hitherto known slide fasteners types only one of the two faces comprises such projecting guide bead.

Another reason of the improved tab guiding action obtained with the present invention is due to the fact that on both faces of the slide fastener element the connecting portions between the transverse loops formed by the aforesaid filaments A and B are somewhat off-set. In fact, when on one of the tape faces a connecting portion leads to a transverse loop, thus breaking the continuity of the tab guiding slideway, the necessary guiding action is continuous on the other face of the tape, due to the presence of the corresponding filament.

Figure 7:
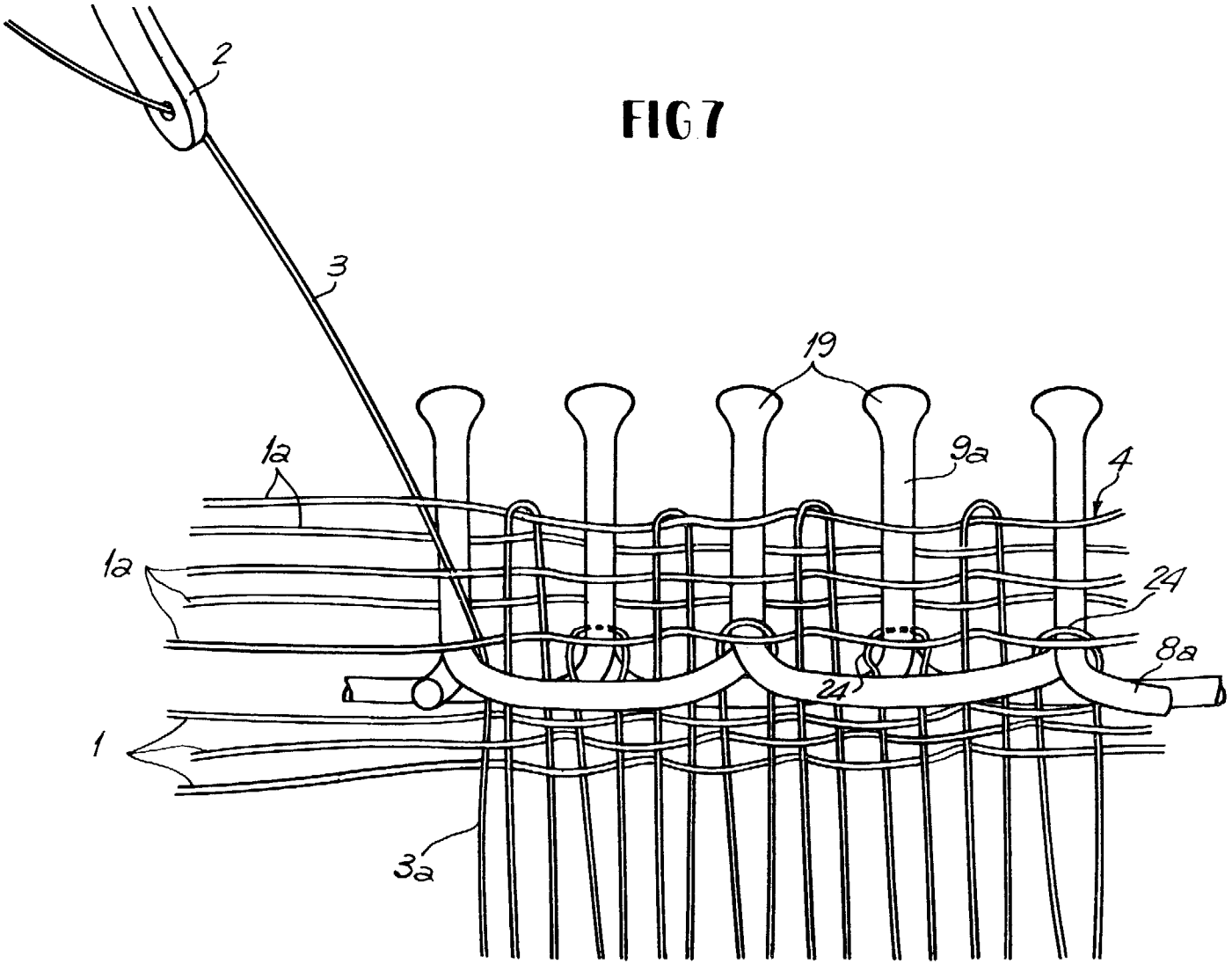
FIG. 7 is a plane view from above showing a modified form of embodiment of the method of this invention.
Figure 8:
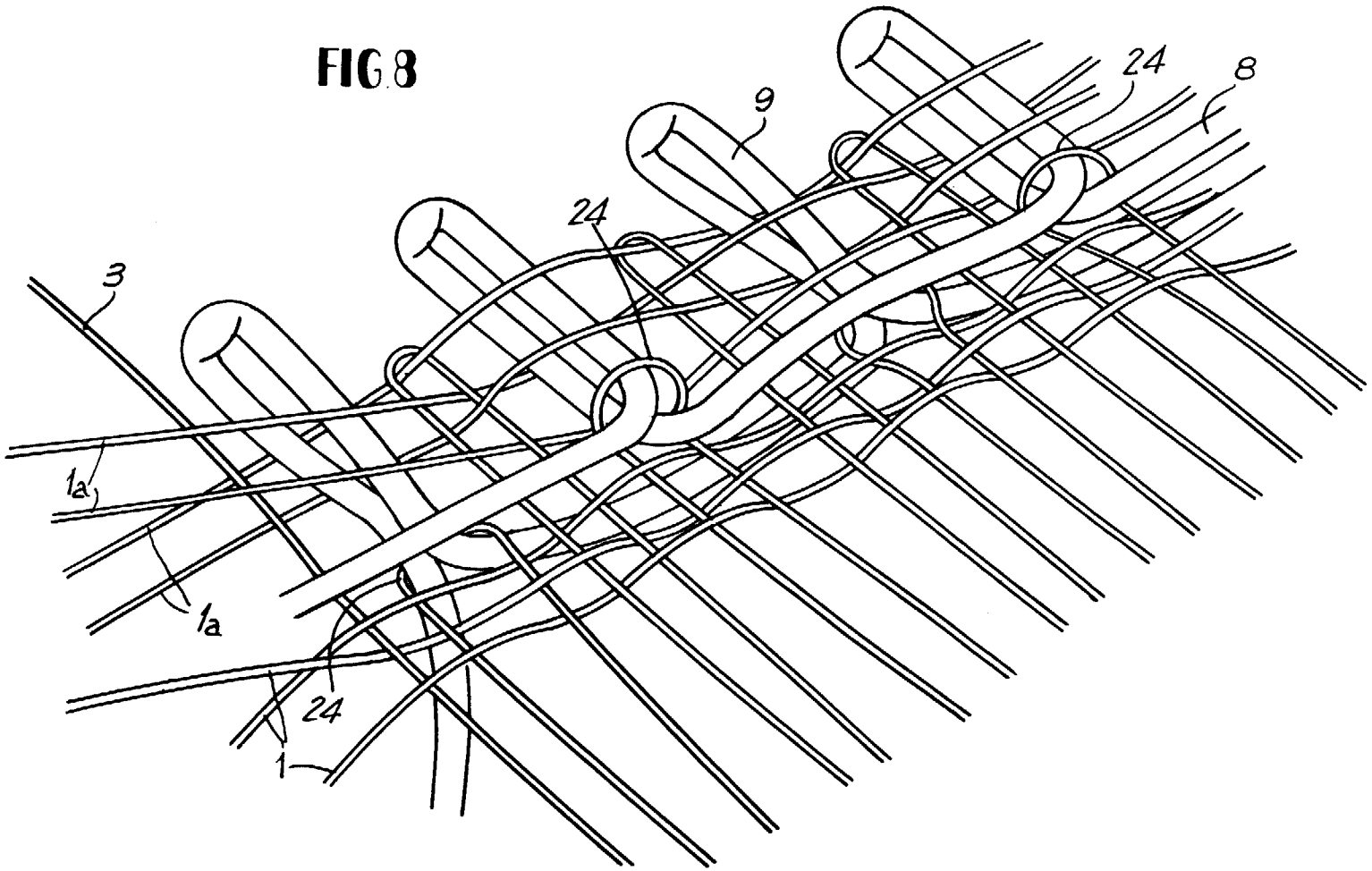
FIG. 8 is a diagrammatic perspective view of the fastener element obtained by carrying out the modified method illustrated in FIG. 7.

Of course, the manufacturing method of this invention should not be construed as being strictly limited to the steps described hereinabove with references to the apparatus illustrated in FIGS. 1 to 3 of the drawings. Thus, FIGS. 7 and 8 illustrate a modified form of embodiment of this method which is intended for improving the holding in position of the transverse loops formed by the two fastener filaments. This result is obtained by properly anchoring each loop at the base, i.e. where each loop merges into the corresponding connecting portions 20 or 23.

This anchoring action is produced by means of another loop 24 formed by means of the weft yarn 3 at this location. This is obtained by causing the premature return of the weft yarn on itself before attaining the corresponding edge 4 of the tape, at the location of each transverse loop of the two filaments A and B of the corresponding fastener element.

The premature return of the weft yarn 3 at 24 to the bottom of the turns formed by the fastener wire is obtained by modifying the manner in which the warp yarns 1*a* provided along the selvedge are "lifted". In fact, it is only necessary that all the selvedge warp yarns 1*a* be lowered at the location corresponding to the time of the positive stroke of needle 2 so that the weft yarn 3 can pass above these warp yarns and then, during the return stroke, this yarn 3 will not find any obstacle before attaining the very base of the fastener wire, so that it will form a loop 24 only at this point.

As a matter of fact, this technique is well known and conventional in the art of passementry, when patterns are formed on only one portion of the tape width.

With this modification in relation to the other warp yarns 1*b* (which takes place only at the proper time) the weft yarn 3*a* will form a loop 24 at the root of each transverse loop of the two fastener filaments as illustrated in FIGS. 7 and 8. Thus, the loops formed by means of the fastener filament are safely anchored while avoiding notably any possibility of untimely slippage thereof in the transverse direction.

Instead of disposing the needles for introducing the two filaments A and B on either side of the movable sheet for warp yarns 1, it would also be possible to dispose said needles in front of a same face of this sheet, provided that said needles are off-set to each other in the longitudinal direction. In this case it would be necessary of course to provide unequal time intervals between the moments whereat said needles are rendered operative.

On the other hand, in this case it would be necessary to use two needles 10*a* and 11*a* (see FIG. 9) of different types, capable of producing the winding in opposite directions of the loops formed with one and the other filaments; in this case, one needle, for example needle 11*a*, may be identical with the above-described needles 10 or 11 of the preceding example, and comprise a groove 15 on the side opposed to its pivot axis. As to the other needle 10*a*, it would then comprise a groove but on the opposite side, i.e. towards the pivot 14, in order to permit the winding the loops in the other direction with respect to the winding direction of needle 11*a*.

Of course, many other modifications may be contemplated in connection not only with the various steps of the manufacturing method of this invention but also with the component elements of the apparatus employed for carrying out this method, and with the fastener elements themselves.

Possibly, the two sides of each loop formed by means of the fastener filaments may have a different relative position in lieu of the direct superposition contemplated in the above-described examples.

The coupling members could also be manufactured differently. Thus, instead of forming these members by pulling the retaining member 12, it would be possible to provide preliminary distortions on the fastener elements at properly spaced locations so that these distortions lie on the end of the projecting loops formed by these filaments during their insertion in the course of the tape weaving operation.

But, conversely, it would also be possible to form these coupling members after making the loops of the two fastener filaments and inserting these filaments throught the tape.

Besides, the two fastener filament inserting looping needles contemplated in the examples illustrated could be replaced by rectilinear needles performing simple reciprocating movements, or by any other suitable members capable of positioning the two fastener filaments.

Figure 14:
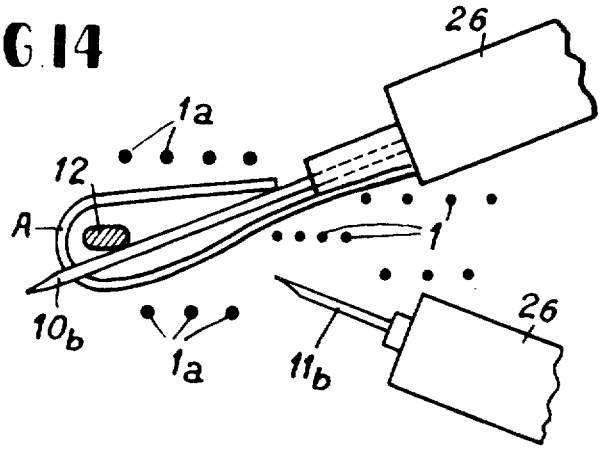
FIG. 14 is a view similar to FIGS. 2 and 3, illustrating a modified embodiment of the method of this invention.
Figure 15:
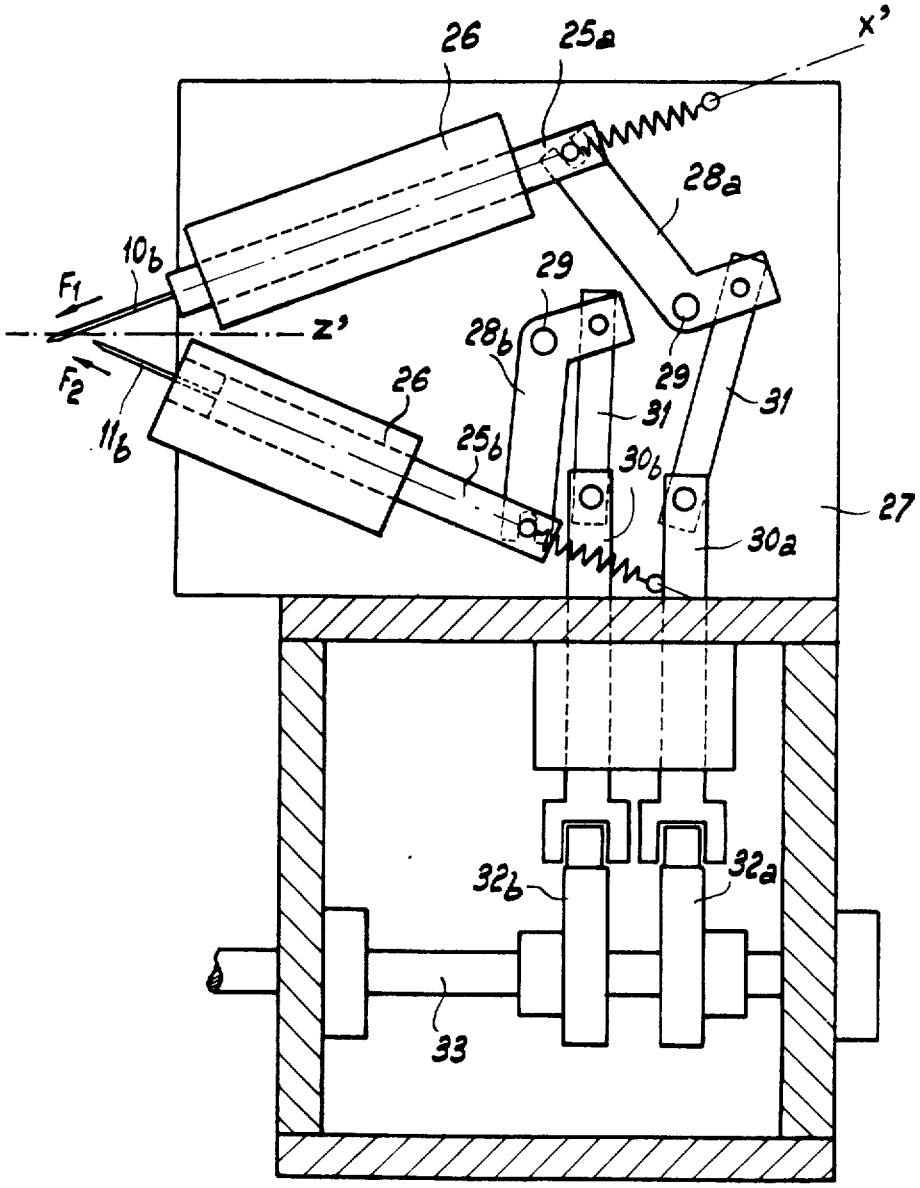
FIG. 15 is a part-sectional, part-elevational view showing the device for controlling the needle for inserting the two filaments in this modified embodiment.

FIGS. 14 and 15 illustrate this modified embodiment.

As clearly shown, in this modified embodiment two separate rectilinear insertion needles 10*b* and 11*b* are used; a reciprocating motion is imparted thereto along two oblique axes, instead of a pivotal motion as in the case of the curved needles 10 and 11.

Both rectilinear needles 10*b* and 11*b* are disposed in a same plane perpendicular to the general plane Z—Z′ of the tape being woven on the loom contemplated therefor. These needles are secured to a pair of movable supports 25*a* and 25*b* slidably mounted in a pair of stationary tubular guide members 26 rigid with a bracket 27 secured to the loom frame structure.

These movable supports 25*a* and 25*b* for the aforesaid pair of needles are driven through a pair of bent levers 28*a*, 28*b* fulcrumed to a pair of fixed pivot pins 29 and driven in turn from push-rods 30*a* and 30*b* connected through links 31 to said levers.

These push-rods register with a pair of rotary control cams 32*a* and 32*b* carried by a rotary shaft 33 adapted to be coupled to one of the rotary shafts of the loom.

The contour of these cams 32*a*, 32*b* is such that they control by turns the movement of needle 10*b* in the direction of the arrow $F_1$ so as to insert the corresponding wire into the tape, whereafter this needle is withdrawn and the other needle 11*b* is moved in the direction of the arrow $F_2$ to insert the wire carried by this needle into the tape, and finally returning the needle backwards, and so forth.

Of course, these movements are synchronized with those of the retaining member 12 provided along the tape selvedges so as to retain each loop thus formed by means of one and the other of said pair of wires or filaments.

As far as the apparatus employed for carrying out the method of this invention, it may be noted that different types of weaving looms may be used. However, in the case of a needle-type weaving loom, it would be preferable to use a loom type providing the room necessary for mounting the pair of additional needles intended for introducing the fastener filaments, and also for positioning the retaining member 12 and the various corresponding mechanical control means. However, a conventional loom could also be used, notably a loom comprising one or a plurality of shuttles, for introducing the weft yarn.

What I claim is:

1. A slide fastener element comprising a tape woven with warp and weft yarns, two separate resilient filaments inserted between said warp and weft yarns, each said filament being formed into a helix, the loops of one said helix being wound in a direction opposite the direction of winding of the loops of the other said helix, said loops being imbricated at spaced intervals, a lateral portion of each loop constituting a coupling member along an edge of said tape, the loops of each helix being interconnected by connecting portions extending in the direction of the warp yarns on the side of said helices opposite to the coupling members, every alternate loop belonging to a different one of said helices formed by said two filaments, the tape distorting stress in one said helix being essentially offset by the tape distorting stress in the other said helix by virtue of said helices being wound in opposite directions.

* * * * *